US008092235B2

(12) United States Patent
Frantum, Jr. et al.

(10) Patent No.: US 8,092,235 B2
(45) Date of Patent: Jan. 10, 2012

(54) CONNECTOR ASSEMBLY WITH GROUPED CONTACTS

(75) Inventors: Albert Washington Frantum, Jr., Mount Joy, PA (US); Michael Allen Blanchfield, Camp Hill, PA (US); Richard Wayne Grzybowski, Palmyra, PA (US); Donald Everett Wood, Hummelstown, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 271 days.

(21) Appl. No.: 12/178,802

(22) Filed: Jul. 24, 2008

(65) Prior Publication Data

US 2010/0022140 A1 Jan. 28, 2010

(51) Int. Cl.
*H01R 12/00* (2006.01)

(52) U.S. Cl. ..... 439/79; 439/108; 439/947; 439/78

(58) Field of Classification Search ..... 439/79, 439/78, 947, 540.1, 108
See application file for complete search history.

(56) References Cited

U.S. PATENT DOCUMENTS

| | | | | |
|---|---|---|---|---|
| 5,158,471 | A * | 10/1992 | Fedder et al. | 439/80 |
| 5,195,899 | A * | 3/1993 | Yatsu et al. | 439/101 |
| 6,000,973 | A * | 12/1999 | Mitra | 439/825 |
| 6,089,877 | A * | 7/2000 | Seidel | 439/79 |
| 6,210,240 | B1 * | 4/2001 | Comerci et al. | 439/853 |
| 6,383,039 | B1 * | 5/2002 | Yoneyama et al. | 439/856 |
| 6,402,566 | B1 * | 6/2002 | Middlehurst et al. | 439/699.1 |
| 6,431,886 | B1 | 8/2002 | Ramey et al. | |
| 6,604,967 | B2 | 8/2003 | Middlehurst et al. | |
| 6,923,661 | B1 | 8/2005 | Bogiel et al. | |
| 7,083,433 | B2 * | 8/2006 | Misawa et al. | 439/80 |

* cited by examiner

*Primary Examiner* — Xuong Chung Trans

(57) ABSTRACT

A connector assembly includes a housing and a plurality of contacts. The housing has a plurality of channels that extend between a housing mating end and an opposing back end. The housing mating end is configured to mate with a mating connector. The contacts each have a plurality of contact mating ends and a plurality of contact mounting ends. Each of the contact mating ends extends through one of the channels and is configured to provide a plurality of electrical connections with the mating connector. The contact mounting ends of each contact are arranged in a group and configured to be mounted to a circuit board. The contact mating ends are separated from one another by a first pitch and the contact mounting ends within each group are separated from one another by a second pitch that is smaller than the first pitch.

22 Claims, 6 Drawing Sheets

PRIOR ART

CONNECTOR ASSEMBLY WITH GROUPED CONTACTS

BACKGROUND OF THE INVENTION

The subject matter herein generally relates to connector assemblies and, more particularly, to a connector assembly having a plurality of contacts.

Circuit boards may be electrically connected by mating a connector mounted on each circuit board with one another. The circuit boards may be electrically connected in order to pass, or communicate, data and/or power between the circuit boards. For example, power from one circuit board may pass through one or more conductive traces in the circuit board, through contacts in the connector that is mounted to the circuit board and to contacts in a connector that is mounted to the other circuit board. The connector on the other circuit board may then communicate the power to one or more conductive traces in that circuit board.

Some known connectors that are used to communicate power between circuit boards include individual contacts for each conductive trace in the respective circuit boards. The contacts in these connectors may be spaced too closely together such that adjacent conductive traces in the circuit board to which the connector is mounted also may be spaced too closely together. Arcing and/or shorting between adjacent conductive traces may result if the conductive traces are spaced too closely together. Increasing the spacing between the conductive traces with known electrical connectors would require increasing the spacing between the individual contacts in the connectors. Yet, increasing the spacing between the individual contacts requires increasing the size of the connector. Increasing the size of the connector can result in waste of the limited amount of available real estate on the circuit board.

Thus, a need exists for a connector capable of communicating power between circuit boards while reducing the risk of arcing and/or shorting between the conductive traces in the circuit boards. Moreover, a need exists for such a connector while not increasing the size of the connector.

BRIEF DESCRIPTION OF THE INVENTION

In one embodiment, a connector assembly includes a housing and a plurality of contacts. The housing has a plurality of channels that extend between a housing mating end and an opposing back end. The housing mating end is configured to mate with a mating connector. The contacts each have a plurality of contact mating ends and a plurality of contact mounting ends. Each of the contact mating ends extends through one of the channels and is configured to provide a plurality of electrical connections with the mating connector. The contact mounting ends of each contact are arranged in a group and configured to be mounted to a circuit board. The contact mating ends are separated from one another by a first pitch and the contact mounting ends within each group are separated from one another by a second pitch that is smaller than the first pitch.

In another embodiment, another connector assembly includes a housing and a plurality of contacts. The housing has a mating end that is configured to mate with a mating connector and a mounting end configured to be mounted to a circuit board. Each of the contacts includes a plurality of mating ends and a plurality of mounting ends. The mating ends are configured to engage corresponding contacts in the mating connector. The mounting ends are configured to be mounted to the circuit board and provide an electrical connection between the contacts and the circuit board. The mating ends are arranged in a first pattern at the mating end and the mounting ends are arranged in a second pattern at the mounting end. The mounting ends are more tightly grouped in the second pattern than the mating ends in the first pattern.

In another embodiment, another connector assembly includes a housing, a plurality of upper contacts and a plurality of lower contacts. The housing includes a mating end and a mounting end. The mating end is configured to mate with a mating connector. The mounting end is configured to be mounted to a circuit board. The upper contacts extend between a plurality of upper contact mating ends and a plurality of upper contact mounting ends. The upper contact mating ends are configured to mate with corresponding contacts in the mating connector. The upper contact mounting ends are configured to be mounted to the circuit board. The lower contacts extend between a plurality of lower contact mating ends and a plurality of lower contact mounting ends. The lower contact mating ends are configured to mate with corresponding contacts in the mating connector. The lower contact mounting ends are configured to be mounted to the circuit board. The upper and lower contact mating ends are arranged in a first pattern at the mating end and the upper and lower mounting ends arranged in a second pattern at the mounting end, with each of the upper and lower mounting ends being more tightly packed with respect to one another in the second pattern than each of the upper and lower mating ends in the first pattern.

DETAILED DESCRIPTION OF THE INVENTION

Figure 1:
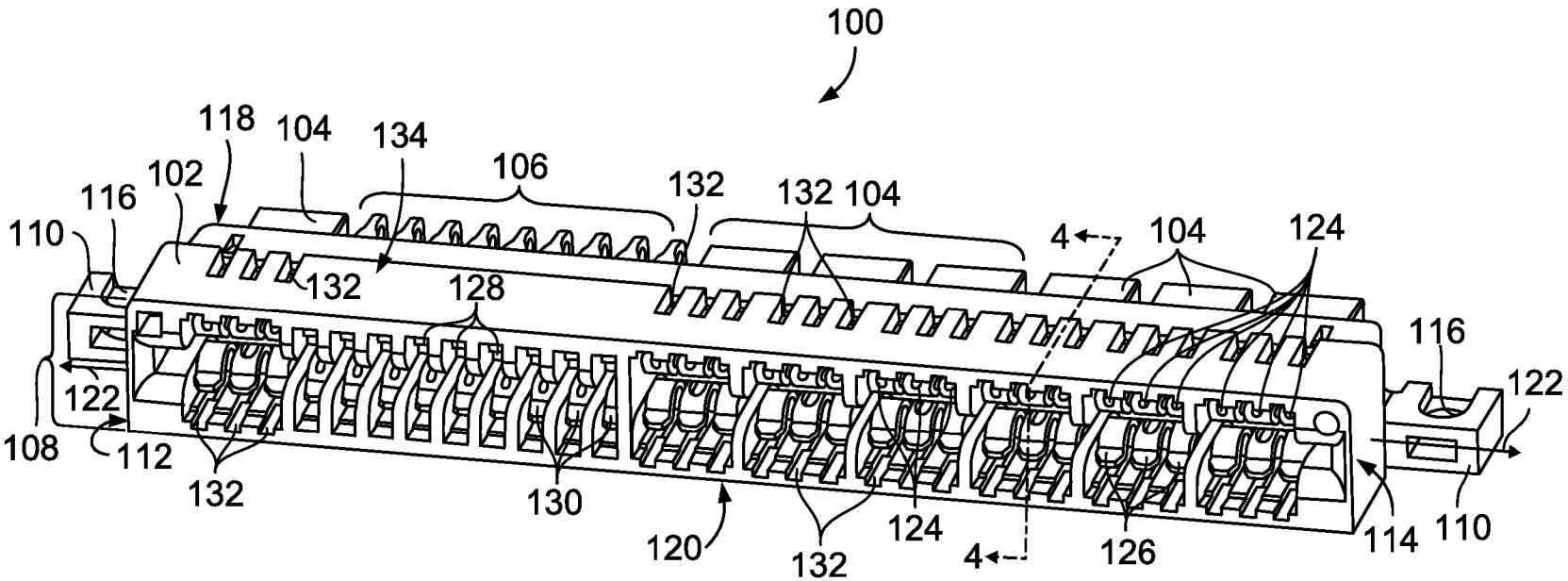
FIG. 1 is a front perspective view of a connector assembly according to one embodiment.

FIG. 1 is a front perspective view of a connector assembly 100 according to one embodiment. The connector assembly 100 includes a housing 102. In the illustrated embodiment, the housing 102 has a shape that is elongated along a longitudinal axis 122. The housing 102 may include, or be formed from, a dielectric material. The housing 102 extends between a mating end 108 and a back end 118.

The mating end 108 is shaped to mate with one or more mating connectors (not shown). For example, the mating end 108 may be shaped to receive a card connector or a bus bar. The mating end 108 may receive a mating connector that is mounted to another circuit board (not shown) in order to communicate power between the circuit board (not shown) to which the connector assembly 100 is mounted and the circuit board to which the mating connector is mounted. While the mating end 108 is shown as receiving a male connector in the illustrated embodiment, the mating end 108 alternatively may be a male connector that is inserted into a female mating connector (not shown).

A mounting end 120 of the housing 102 may be mounted on a circuit board (not shown). For example, the connector assembly 100 may include a pair of mounting ears 110 protruding from opposing ends 112, 114 of the housing 102. Each of the mounting ears 110 may include a hole 116 through which a fastener (not shown) may be inserted to secure the connector assembly 100 to the circuit board, for example. In the illustrated embodiment, the mounting end 120 is substantially perpendicular to, and extends between, the mating and back ends 108, 118.

Figure 2:
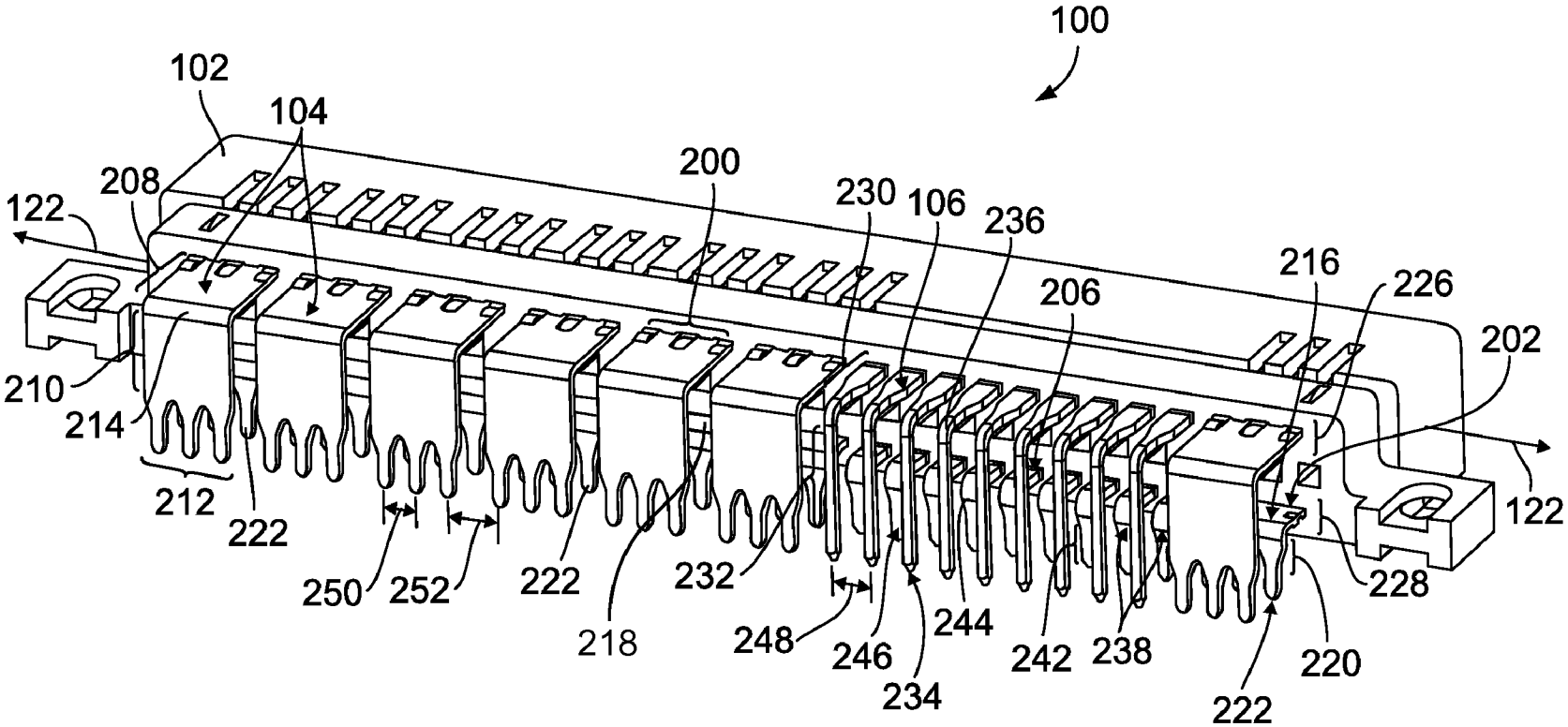
FIG. 2 is a rear perspective view of the connector assembly shown in FIG. 1.

In the illustrated embodiment, the housing 102 holds a plurality of upper power contacts 104, a plurality of lower power contacts 216 (shown in FIG. 2), a plurality of upper signal contacts 106, and a plurality of lower signal contacts 238 (shown in FIG. 2). In one embodiment the upper and lower power contacts 104, 216 may be used to communicate power and the upper and lower signal contacts 106, 238 may be used to communicate data between a mating connector (not shown) that is inserted into the connector assembly 100 and a circuit board (not shown) to which the connector assembly 100 is mounted.

Each of the upper power contacts 104 includes a plurality of upper power contact mating ends 124 and each of the lower power contacts 216 includes a plurality of lower power contact mating ends 126. Alternatively, one or more of the upper power contacts 104 may include a single upper power contact mating end 124. In one embodiment, one or more of the lower power contacts 216 includes a plurality of lower power contact mating ends 126.

Similarly, each of the upper signal contacts 106 includes an upper signal contact mating end 128 and each of the lower signal contacts 238 includes a lower signal contact mating end 130. Alternatively, one or more of the upper signal contacts 106 includes a plurality of upper signal contact mating ends 128. In one embodiment, one or more of the lower signal contacts 238 includes a plurality of lower signal contact mating ends 130. Each of the upper power contact mating ends 124 and the upper signal contact mating ends 128 may be collinearly aligned in a direction parallel to the longitudinal axis 122. Each of the lower power contact mating ends 126 and the lower signal contact mating ends 130 may be collinearly aligned in a direction parallel to the longitudinal axis 122. In another embodiment, one or more of the upper power contact mating ends 124, the upper signal contact mating ends 128, the lower power contact mating ends 126 and the lower signal contact mating ends 130 are not collinearly aligned in a direction parallel to the longitudinal axis 122. For example, the upper power contact mating ends 124 may be staggered about a line that is parallel to the longitudinal axis 122.

In the illustrated embodiment, the housing 102 includes a plurality of ventilation openings 132 in each of opposing top and mounting ends 134, 120 of the housing 102. The ventilation openings 132 permit heat from the upper and lower power contacts 104, 216 (shown in FIG. 2) to be dissipated into the surrounding environment. The ventilation openings 132 may thus reduce the risk of the upper and lower power contacts 104, 216 from overheating and damaging the connector assembly 100.

FIG. 2 is a rear perspective view of the connector assembly 100. Each of the upper and lower power contact mating ends 124, 126 is inserted into an upper or lower back end opening 200, 202, respectively. The upper back end openings 200 may be collinear with one another along a direction that is parallel to the longitudinal axis 122 (shown in FIG. 1) of the housing 102 in one embodiment. For example, the upper back end openings 200 may be oriented in an upper row 226 that extends along a direction that is parallel to the longitudinal axis 122. Similarly, the lower back end openings 202 may be collinear with one another along a direction that is parallel to the longitudinal axis 122. For example, the lower back end openings 202 may be oriented in a lower row 228 that extends along a direction that is parallel to the longitudinal axis 122. Each of the upper and lower signal contact mating ends 128, 130 is inserted into an upper or lower signal contact channel opening 204, 206, respectively. The upper signal contact channel openings 204 may be collinear with one another in a direction that is parallel to the longitudinal axis 122 (shown in FIG. 1) of the housing 102 in one embodiment. For example, the upper signal contact channel openings 204 may be included in the upper row 226. Similarly, the lower signal contact channel openings 206 may be collinear with one another in a direction that is parallel to the longitudinal axis 122. For example, the lower signal contact channel openings 206 may be included in the lower row 228.

The upper power contact mating ends 124 (shown in FIG. 1) are connected to a mating portion 208 of the upper power contact 104. In the illustrated embodiment, the upper power contact mating ends 124 and the mating portions 208 of the upper power contacts 104 are coplanar. In one embodiment, the upper power contact mating ends 124 and the mating portions 208 of the upper power contacts 104 are coplanar with the mounting end 120 (shown in FIG. 1) of the housing 102. For example, the upper power contact mating ends 124 and the mating portions 208 of the upper power contacts 104 may be coplanar with a printed circuit board ("PCB") to which the connector assembly 100 is mounted.

The upper power contact 104 includes a mounting portion 210 and an upper power contact mounting end 212. In the illustrated embodiment, a plurality of upper power contact mounting ends 212 is connected to the mounting portion 210. In another embodiment, a single upper power contact mounting end 212 may be connected to the mounting portion 210. The mounting portion 210 and the upper power contact mounting end 212 may be coplanar. In one embodiment, the mounting portion 210 and the tipper power contact mounting end 212 are substantially parallel to the mating end 108 (shown FIG. 1) and/or back end 118 of the housing 102. In the illustrated embodiment, the upper power contact mounting ends 212 are collinearly oriented along a direction that is parallel to the longitudinal axis 122. In another embodiment, the tipper power contact mounting ends 212 may not be collinearly oriented along a direction that is parallel to the longitudinal axis 122. For example, at least a plurality of the upper power contact mounting ends 212 may be staggered on opposite sides of a line that is parallel to the longitudinal axis 122. The upper power contact mounting ends 212 may include pins that are inserted into a circuit board (not shown) to electrically connect the upper power contact 104 with one or more conductive traces (not shown) in the circuit board. For example, the upper power contact mounting ends 212 may include pins with compliant tails that may be press-fit into a cavity in the circuit board. In another example, the upper power contact mounting ends 212 may include a pin that may be soldered or otherwise terminated to a conductive trace in the circuit board. In one embodiment, the upper power contact mounting ends 212 are electrically connected with a single conductive trace in a circuit board.

The mating and mounting portions 208, 210 of the upper power contact 104 oppose one another and may be collectively referred to as a contact plate. A bend 214 between the mating and mounting portions 208, 210 is shown in the illustrated embodiment. The bend 214 may be approximately 90 degrees, for example. In such an embodiment, the mating and mounting portions 208, 210, as well as the upper power contact mating ends 124 and the upper power contact mounting ends 126, are substantially perpendicular to one another. In another embodiment, the bend 214 provides an angle between the mating and mounting portions 208, 210 other than 90 degrees. In another embodiment, the bend 214 is not included in the upper power contact 104. For example, the mating and mounting ends 208, 210 may be substantially flat with the housing mounting end 120 provided at the housing back end 118. While the bend 214 is shown outside of the housing 102 in the illustrated embodiment, in another embodiment the bend 214 may be enclosed within the housing 102. For example, the housing 102 may at least partially enclose the upper and lower power contacts 104, 216 and the upper and lower signal contacts 106, 238.

In one embodiment, the upper power contact mating end 124, the mating portion 208 of the upper power contact 104, the mounting portion 210 of the upper power contact 104 and the upper power contact mounting ends 212 are integrally formed with one another to form a unitary upper power contact 104. For example, the upper power contact 104 may be stamped and formed from a sheet of conductive material. In another embodiment, one of more of the upper power contact mating end 124, the mating portion 208 of the upper power contact 104, the mounting portion 210 of the upper power contact 104 and the upper power contact mounting ends 212 is separately formed or created, and then is connected to the remaining components of the upper power contact 104. For example, the upper power contact mounting ends 212 may be separately formed and then affixed to the mounting portion 210.

Similar to the upper power contacts 104, the lower power contact mating ends 126 (shown in FIG. 1) are connected to a mating portion 218 of the lower power contacts 216. In the illustrated embodiment, the lower power contact mating ends 126 and the mating portions 218 of the lower power contacts 216 are coplanar. In one embodiment, the lower power contact mating ends 126 and the mating portions 218 of the lower power contacts 216 are coplanar with the upper power contact mating ends 124 and the mating portion 208 of the upper power contact 104. The lower power contact mating ends 126 and the mating portions 218 of the lower power contacts 216 may be coplanar with the mounting end 120 of the housing 102. The lower power contact 216 includes a mounting portion 220 and a lower power contact mounting end 222. In the illustrated embodiment, a plurality of lower power contact mounting ends 222 is connected to the mounting portion 220. In another embodiment, a single lower power contact mounting end 222 may be connected to the mounting portion 220. The mounting portion 220 and the lower power contact mounting end 222 may be coplanar. In one embodiment, the mounting portion 220 and the lower power contact mounting end 222 are coplanar with the mounting portion 210 of the upper power contact 104 and the upper power contact mounting end 212. In one embodiment, the mounting portion 220 and the lower power contact mounting end 222 are substantially parallel to the mating end 108 (shown FIG. 1) and/or the back end 118 (shown in FIG. 1) of the housing 102. In the illustrated embodiment, the lower power contact mounting ends 222 are collinearly oriented along a direction that is parallel to the longitudinal axis 122. In another embodiment, the lower power contact mounting ends 222 may not be collinearly oriented along a direction that is parallel to the longitudinal axis 122. For example, at least a plurality of the lower power contact mounting ends 222 may be staggered on opposite sides of a line that is parallel to the longitudinal axis 122.

The lower power contact mounting ends 222 may include pins that are inserted into a circuit board (not shown) to electrically connect the lower power contact 216 with one or more conductive traces (not shown) in the circuit board. For example, the lower power contact mounting ends 222 may include pins with compliant tails and/or pins that may be soldered or otherwise terminated to a cavity in the circuit board. In one embodiment, the lower power contact mounting ends 222 are electrically connected with a single conductive trace in a circuit board. For example, the lower power contact 216 may electrically connect a plurality of lower power contact mating ends 126 (shown in FIG. 1) with a single-conductive trace in a circuit board.

The mating and mounting portions 218, 220 of the lower power contact 216 oppose one another and may be collectively referred to as a contact plate. A bend 224 between the mating and mounting portions 218, 220 is included in the illustrated embodiment. The bend 224 may be approximately 90 degrees, for example. In such an embodiment, the mating and mounting portions 218, 220, as well as the lower power contact mating ends 126 and the lower power contact mounting ends 222, are substantially perpendicular to one another. In another embodiment, the bend 224 provides an angle between the mating and mounting portions 218, 220 other than 90 degrees. In another embodiment, the bend 224 is not included in the lower power contact 216. For example, the mating and mounting ends 218, 220 may be substantially flat with the housing mounting end 120 provided at the housing back end 118.

In one embodiment, the lower power contact mating end 126, the mating portion 218 of the lower power contact 216, the mounting portion 220 of the lower power contact 216 and the lower power contact mounting ends 222 are integrally formed with one another to form a unitary lower power contact 216. For example, the lower power contact 216 may be stamped and formed from a sheet of conductive material. In another embodiment, one or more of the lower power contact mating end 126, the mating portion 218, the mounting portion 220 and the lower power contact mounting ends 222 is separately formed or created, and then is connected to the remaining components of the lower power contact 216. For example, the lower power contact mounting ends 222 may be separately formed and then affixed to the mounting portion 220.

The upper signal contacts 106 include a mating portion 230 and a mounting portion 232 separated by a bend 236. In the illustrated embodiment, the bend 236 is approximately 90 degrees such that the mating and mounting portions 230, 232 are substantially perpendicular to one another. In another embodiment, the bend 236 is an angle other than 90 degrees. In one embodiment, the bend 236 is not present in the upper signal contact 106 so that the mating and mounting portions 230, 232 are substantially coplanar. The upper signal contact mating end 128 may be connected to the mating portion 230. The mounting portion 232 is connected to the mating portion 230. At least a portion of the mounting portion 232 may be inserted into a circuit board (not shown) to electrically connect the upper signal contact 106 to a conductive trace (not shown) in the circuit board. For example, in the illustrated embodiment, a single pin 234 is connected to the mounting portion 232. The pin 234 may include a compliant tail or may be shaped to be soldered or otherwise terminated to the circuit board. In another embodiment, a plurality of pins 234 is connected to the mounting portion 232. The mounting portion 232 and the pin 234 may be coplanar. In one embodiment, the mounting portion 232 and the pin 234 are substantially parallel to the mating end 108 (shown FIG. 1) and/or back end 118 of the housing 102.

The lower signal contacts 238 include a mating portion 240 and a mounting portion 242 separated by a bend 244. In the illustrated embodiment, the bend 244 is approximately 90 degrees such that the mating and mounting portions 240, 242 are substantially perpendicular to one another. In another embodiment, the bend 244 is an angle other than 90 degrees. In one embodiment, the bend 244 is not present in the lower signal contact 238 so that the mating and mounting portions 242, 244 are substantially coplanar. The lower signal contact mating end 130 may be connected to the mating portion 240. The mounting portion 242 is connected to the mating portion 240. At least a portion of the mounting portion 242 may be inserted into a circuit board (not shown) to electrically connect the lower signal contact 238 to a conductive trace (not shown) in the circuit board. For example, in the illustrated embodiment, a single pin 246 is connected to the mounting portion 242. The pin 246 may include a compliant tail or may be shaped to be soldered or otherwise terminated to the circuit board. In another embodiment, a plurality of pins 246 is connected to the mounting portion 242. The mounting portion 242 and the pin 246 may be coplanar. In one embodiment, the mounting portion 242 and the pin 246 are substantially parallel to the mating end 108 (shown FIG. 1) and/or back end 118 of the housing 102.

The mounting portions 232 of adjacent upper signal contacts 106 may have a pitch that is defined as a mounting spacing 248. For example, the center lines of the mounting portions 232 of adjacent upper signal contacts 106 may be separated by the mounting spacing 248. In one embodiment, the mounting portions 242 of adjacent lower signal contacts 238 may have a pitch that is defined as the mounting spacing 248. For example, the center lines of the mounting portions 242 of adjacent lower signal contacts 238 may be separated by the mounting spacing 248. Adjacent ones of the upper and lower power contact mounting ends 212, 222 may have a pitch that is defined as a mounting spacing 250. For example, the center lines of the upper power contact mounting ends 212 may be separated from one another by the mounting spacing 250. Similarly, the center lines of the lower power contact mounting ends 222 may be separated from one another by the mounting spacing 250. The center lines of the outermost ones of the upper power contact mounting ends 212 that are part of the same upper power contact 104 may be separated from the nearest upper power contact mounting end 212 in an adjacent upper power contact 104 by a contact separation distance 250. For example, each group of the upper power contact mounting ends 212 that are connected to the same upper power contact 104 may be separated from one another by the contact separation distance 252. Similarly, in one embodiment, the outermost ones of the lower power contact mounting ends 222 that are part of the same lower power contact 216 may be separated from the nearest lower power contact mounting end 222 in an adjacent lower power contact 216 by the contact separation distance 252. For example, the distance between the center line of an outermost lower power contact mounting end 222 that is connected to one lower power contact 216 and the center line of an outermost lower power contact mounting end 222 that is connected to an adjacent lower power contact 216 may be the contact separation distance 252.

Figure 3:
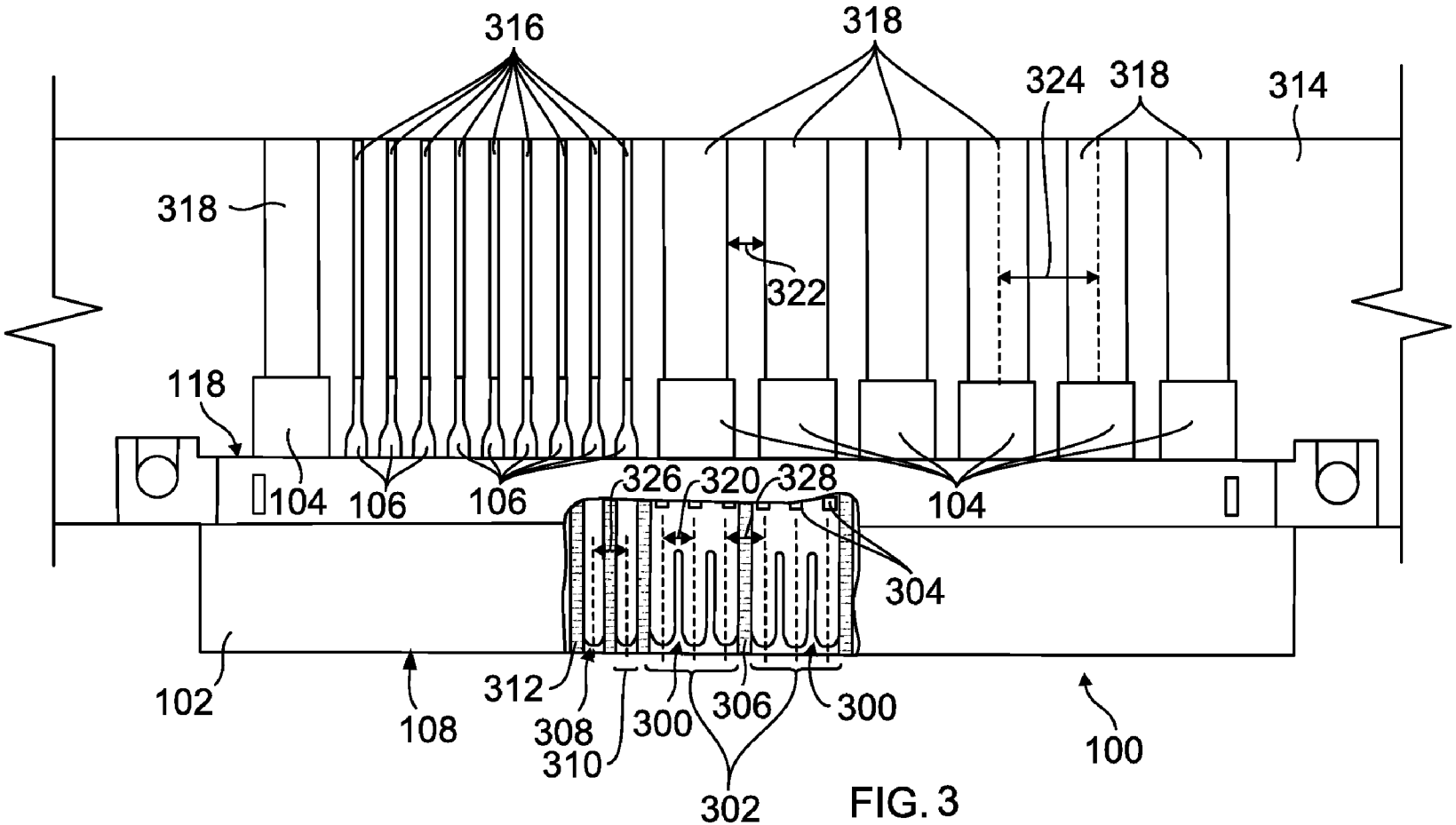
FIG. 3 is a partial cut away plan view of the connector assembly shown in FIG. 1 and mounted to a circuit board.

FIG. 3 is a partial cut away plan view of the connector assembly 100 mounted to a circuit board 314. The ventilation openings 132 (shown in FIG. 1) are not shown in FIG. 3. In one embodiment, only a portion of the circuit board 314 is shown in FIG. 3. The circuit board 314 includes a plurality of signal traces 316 and a plurality of power traces 318. Each of the upper and lower signal contacts 106, 238 may be electrically connected to one or more signal traces 316. In one embodiment, the upper signal contacts 106 are electrically connected to the signal traces 316 and the lower signal contacts 238 are electrically connected to other signal traces (not shown). For example, the lower signal contacts 238 may be electrically connected to signal traces that are located in a layer of the circuit board 314 below the signal traces 316 or on an opposing side of the circuit board 314. The signal traces 316 are conductive traces in the circuit board 314 that provide a conductive pathway for the communication of data signals. For example, the signal traces 316 may be used to communicate data information between the upper or lower signal contacts 106, 238 and a peripheral device (not shown) that is electrically connected to the signal traces 316.

Each of the upper and lower power contacts 104, 216 may be electrically connected to one or more power traces 318. In one embodiment, the upper power contacts 104 are electrically connected to the power traces 318 and the lower power contacts 216 are electrically connected to other power traces (not shown). For example, the lower power contacts 216 may be electrically connected to signal traces that are located in a layer of the circuit board 314 below the power traces 318 or on an opposing side of the circuit board 314. The power traces 318 are conductive traces in the circuit board 314 that provide a conductive pathway for the supply of electrical power. For example, the power traces 318 may be used to provide alternating current ("AC") between the upper or lower power contacts 104, 216 and a peripheral device (not shown) that is electrically connected to the power traces 316. In another example, the power traces 318 may be used to provide direct current ("DC") between the upper or lower power contacts 104, 216 and the peripheral device that is electrically connected to the power traces 316. In one embodiment where AC is provided using the upper or lower power contact 104, 216 and the power trace 316, the upper or lower power contact 104, 216 includes two mounting ends 212, 222. In one embodiment where DC is provided using the upper or lower power contact 104, 216 and the power trace 316, the upper or lower power contact 104, 216 includes three mounting ends 212, 222.

An upper power contact channel 300 may extend between an upper power contact mating end opening 302 and the upper back end opening 200 (shown in FIG. 2) at the back end 118. Each of the upper power contacts 104 may be inserted into the upper power contact channel 300 through the upper back end opening 200. In the illustrated embodiment, the upper power contact mating ends 124 are held within the upper power contact channel 300. For example, the upper power contact mating ends 124 may not protrude through the mating end opening 302 past the mating end 108. Neighboring upper power contact channels 300 may be physically separated from one another by a wall 306. The wall 306 may include a portion of the housing 102 that extends between adjacent upper power contact channels 300.

An upper signal contact channel 308 may extend between an upper signal contact mating end opening 310 and the upper signal contact channel opening 204 (shown in FIG. 2) at the back end 118. Each of the upper signal contacts 106 may be inserted into the upper signal contact channel 308 through the upper signal contact channel opening 204. Neighboring upper signal contact channels 308 may be physically separated from one another by a wall 312. The wall 312 may include a portion of the housing 102 that extends between adjacent upper signal contact channels 308.

As shown in FIG. 3, the upper power contacts 104 may include three upper power contact mating ends 124 and the upper signal contacts 106 may include one upper signal contact mating end 128. Similarly, the lower power contacts 216 may include three lower power contact mating ends 126 and the lower signal contact 238 may include one lower signal contact mating end 130. In another embodiment, one or more of the upper and lower power contacts 104, 216 may include a different number of upper and lower power contact mating ends 124, 126 and one or more of the upper and lower signal contacts 106, 238 may include a different number of upper and lower signal contact mating ends 128, 130.

The mating portion 208 of the upper power contact 104 may include one or more cavities 304 that are used to secure the upper power contact 104 in the housing 102. For example, the housing 102 may include protrusions (not shown) that extend down from the upper power contact channel 300 and into the cavities 304 to prevent the upper power contact 104 from being removed from the upper power contact channel 300. The mating portion 218 (shown in FIG. 2) of the lower power contacts 216 (shown in FIG. 2) may include one or more cavities (not shown) similar to the mating portion 208 of the upper power contacts 104.

As shown in FIG. 3, in one embodiment the upper signal contacts 106 include a single upper signal contact mating end 128 that is connected to a single mounting portion 232 and a single pin 234. Each of the upper signal contacts 106 is electrically connected to the signal trace 316. Similarly, the lower signal contacts 238 each include a single lower signal contact mating end 130 that is connected to a single mounting portion 242 and a single pin 246. Each of the lower signal contacts 238 is electrically connected to one of the signal traces 316. Given the relatively lower power used to communicate data signals using the signal traces 316, the upper and lower signal contacts 106, 238 may be spaced relatively close together and the signal traces 316 to which the upper and lower signal contacts 106, 238 are electrically connected may be spaced relatively close together without considerable risk of arcing or electrical shorting between adjacent ones of the signal traces 316.

In one embodiment the upper power contacts 104 include a plurality of upper power contact mating end 124 that are grouped together in the housing 102 and connected to a single mating portion 208 (shown in FIG. 2). The mating portion 208 is connected to a single mounting portion 210 (shown in FIG. 2), which is connected to one or more upper power contact mounting ends 212 (shown in FIG. 2). Similarly, the plurality of lower power contact mating ends 126 are grouped together in the housing 102 and connected to a single mating portion 218 (shown in FIG. 2), which is connected to one or more lower power contact mounting ends 222. Thus, in one embodiment, the upper and lower power contacts 104, 216 combine a plurality of mating ends 124, 126 into a single electrical connection with the power trace 318 at the mounting ends 212, 222.

In one embodiment, a mating spacing 320 between the center lines of adjacent upper and lower power contact mating ends 124, 126 for a particular upper or lower power contact 104, 216 is approximately the same as a mating spacing 328 between the center lines of the outermost upper and lower power contact mating ends 124, 126 in an adjacent upper or lower power contact 104, 216. In one embodiment, the mating spacing 320 and/or mating spacing 328 is approximately the same as a mating spacing 326 between the center lines of adjacent upper and lower signal contact mating ends 128, 130. For example, a pitch of the upper and lower power contact mating ends 124, 126 may be approximately the same as the pitch of the upper and lower signal contact mating ends 128, 130. In one embodiment, the mating spacings 320, 326 are approximately 2.54 millimeters. The mating spacings 320, 326 may be approximately the same as the spacing between the centers of the contacts (not shown) in a mating connector (not shown) that mates with the connector assembly 100. For example, the mating spacings 320, 326 may be an industry standard spacing established by a standards association such as Underwriters Laboratory ("UL") or the Canadian Standards Association ("CSA").

By combining the upper power contact mating ends 124 and/or by combining the lower power contact mating ends 126 in accordance with one embodiment, a power trace spacing 322 between adjacent power traces 318 may be increased over known connectors having approximately the same mating spacing as the mating spacing 320 of the connector assembly 100. In one embodiment, a power trace pitch 324 is a pitch of adjacent power traces 318. For example, the power trace pitch 324 may be the distance between the centers of adjacent power traces 318. The power trace pitch 324 may be increased over known connectors having approximately the same mating spacing as the mating spacing 320 of the connector assembly 100. Thus, in one embodiment, combining multiple power contact mating ends (including the upper and lower power contact mating ends 124, 126) into a single electrical connection (for example, between each of the groups of the upper and lower power contact mounting ends 212, 222 and the power traces 318) can reduce the density of the power traces 318 in the circuit board 314 while maintaining a standard mating density of the upper and lower power contact mating ends 124, 126 at the mating interface 108 (shown in FIG. 1) of the connector assembly 100.

Figure 4:
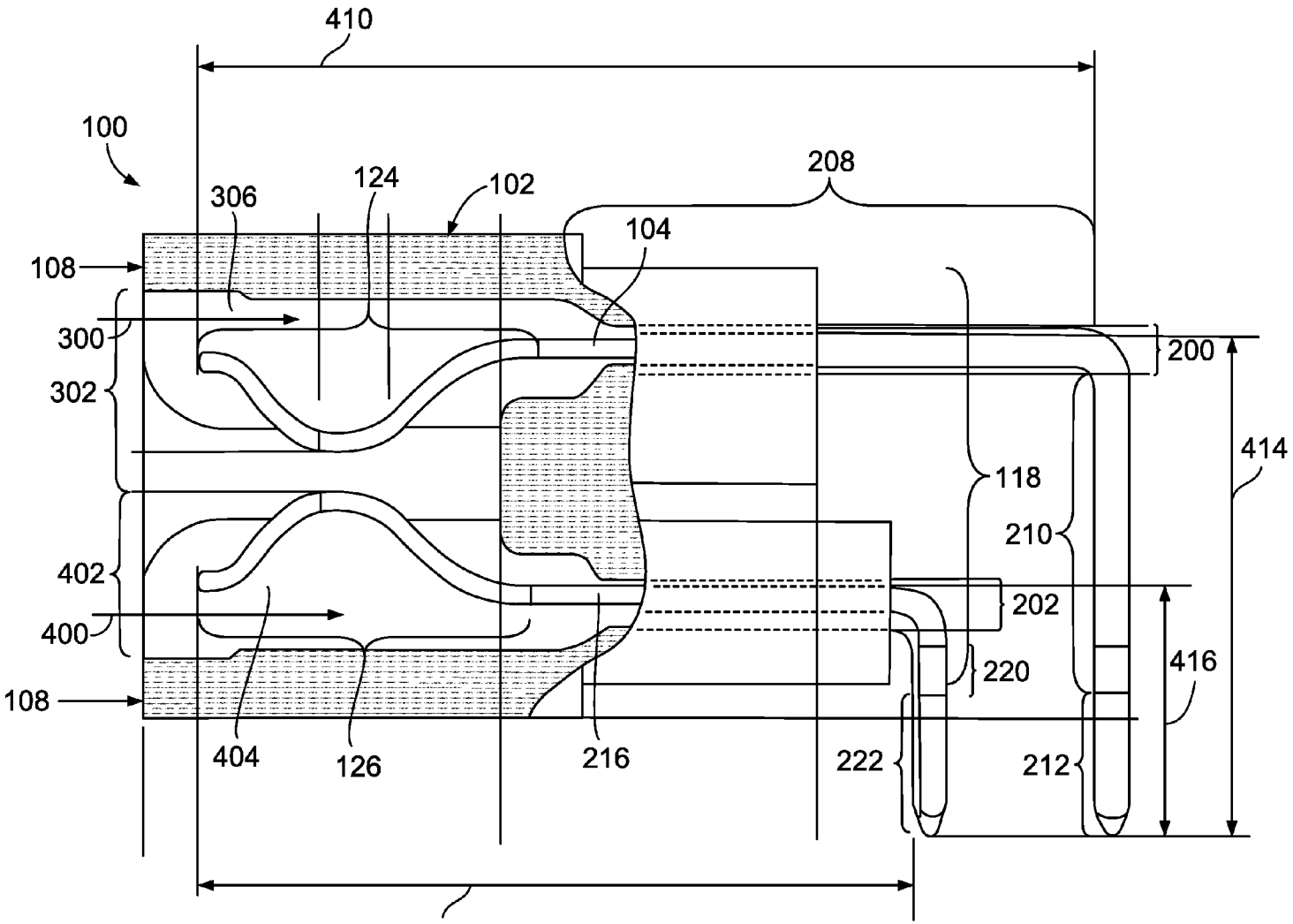
FIG. 4 is a partial cross-sectional view of the connector assembly shown in FIG. 1.

FIG. 4 is a partial cross-sectional view of the connector assembly 100 from line 4-4 in FIG. 1. A lower power contact, channel 400 may extend between a lower power contact mating end opening 402 and the lower back end opening 202 at the back end 118 of the housing 102. Each of the lower power contacts 216 may be inserted into the lower power contact channel 400 through the lower back end opening 202. In the illustrated embodiment, the lower power contact mating ends 126 are held within the lower power contact channel 400. For example, the lower power contact mating ends 126 may not protrude through the mating end opening 402 past the mating end 108. Neighboring lower power contact channels 400 may be physically separated from one another by a wall 404. The wall 404 may include a portion of the housing 102 that extends between adjacent lower power contact channels 400.

As described above, the upper power contact channel 300 may extend between the upper power contact mating end opening 302 and the upper back end opening 200 at the back end 118 of the housing 102. In the illustrated embodiment, the upper power contact channel 300 has a bottleneck shape. For example, the size of the upper power contact channel 300 decreases from the size of the upper power contact channel 300 at the upper power contact mating end opening 302 to the size of the upper power contact channel 300 at the upper back end opening 200. The wall 306 physically separates adjacent upper power contact channels 300.

In the illustrated embodiment, the upper and lower power contact mating ends 124, 126 include arcuate portions 406, 408. The arcuate portions 406, 408 may extend towards one another. The arcuate portions 406, 408 may be biased away from one another when one or more contacts (not shown) of a mating connector (not shown) is inserted into the housing 102 at the mating end 108 between the upper and lower power contact mating ends 124, 126. The contacts may engage one or both of the arcuate portions 406, 408 to electrically connect the mating connector with the upper and lower power contacts 104, 216.

In one embodiment, both of the upper and lower power contacts 104, 216 are L-shaped. For example, each of the upper and lower power contacts 104, 216 has the shape of the letter "L." In the illustrated embodiment, the upper power contact mating end 124 and the mating portion 208 of the upper power contact 104 has a length 406. The lower power contact mating end 126 and the mating portion 218 of the lower power contact 216 has a length 408. In one embodiment, the length 406 of the upper power contact 104 is greater than the length 408 of the lower power contact 216. The upper power contact mounting end 212 and the mounting portion 210 of the upper power contact 104 has a height 414. The lower power contact mounting end 222 and the mounting portion 220 of the lower power contact 216 has a height 416. In one embodiment, the height 414 is greater than the height 416.

Figure 5:
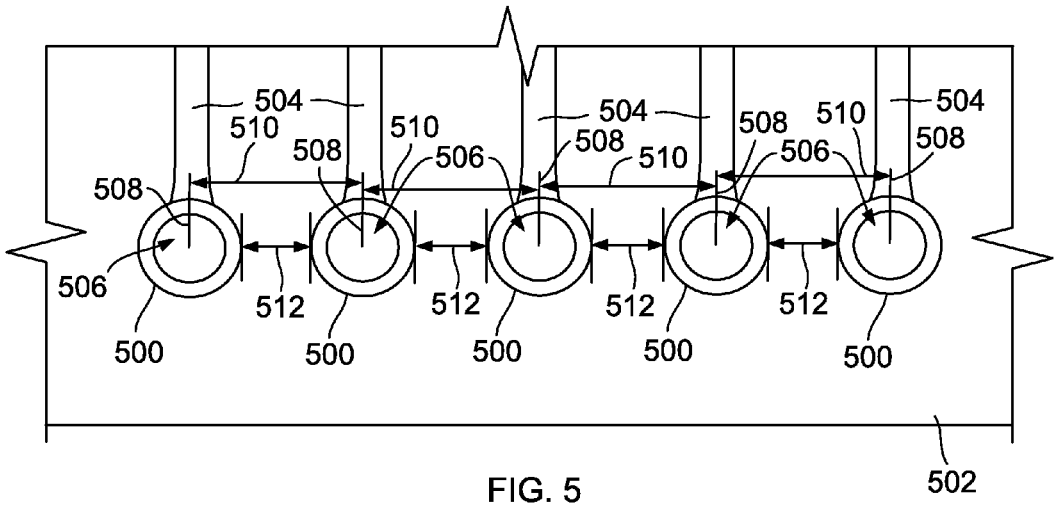
FIG. 5 is a plan view of a plurality of annular rings disposed on a circuit board.

FIG. 5 is a plan view of a plurality of annular rings 500 disposed on a circuit board 502. The annular rings 500 include or are formed of a conductive material and are electrically connected to a plurality of conductive traces 504 in the circuit board 502. Each of the annular rings 500 surrounds an opening 506 that is configured to receive a mounting pin (not shown) of a power and/or signal contact (not shown) used in known connectors (not shown) that are used to mate two circuit boards together. The mounting pins are inserted into the openings 506 and then secured within the openings 506 by flowing solder between the pins and the annular rings 500. The solder secures the pins within the openings 506 and electrically connects the pins to the annular rings 500.

Center lines 508 of the annular rings 500 are separated from one another by a pitch 510. In such known connectors, the pitch 510 is approximately the same as the pitch of the mating ends (not shown) of the power and/or signal contacts. For example, the center lines (not shown) of the mating ends of the power and signal contacts in known connectors and the pitch 510 may be approximately 2.54 millimeters. The annular rings 500 may be separated from one another by a clearance spacing 512. The clearance spacing 512 may be the same for substantially all of the annular rings 500 for such known connectors. Given the limited amount of real estate on the circuit board 502 and combined with the pitch 510 of the mounting and mating ends of the power and signal contacts for known connectors, the annular rings 500 may not be able to be further separated from one another. Moreover, the clearance spacing 512 may be insufficient for some levels of power communicated by the power contacts. For example, the clearance spacing 512 for some known connectors is approximately 1.04 millimeters. If too large of a current is communicated using power contacts that are mounted in adjacent annular rings 500, the current may are or short between the annular rings 500. For example, if more than approximately 5 or 6 Amps of current are communicated using power contacts with mating ends mounted in the annular rings 500, the current may arc or short between the annular rings 500. Moreover, the current that may be communicated using power contacts mounted to annular rings 500 having the clearance spacing 512 may be limited by an industry standard. For example, UL 1950 is one industry standard written by Underwriters Laboratory Inc. that may limit the amount of current that may be carried by a power contact with a given clearance spacing 512 between the annular rings 500. In order to prevent such arcing and shorting and/or to meet an industry standard minimum spacing between the annular rings 500, known connectors remove one or more signal and/or power contacts so that one or more annular rings 500 are not used to communicate power. In doing so, the distance between annular rings 500 that do communicate power is increased. However, removing signal and/or power contacts also reduces the number of contacts that may be used to communicate data and/or power. Thus, known connectors may waste valuable real estate on the circuit board 502 in order to prevent arcing or shorting between the annular rings 500 that are electrically connected to power contacts.

Figure 6:
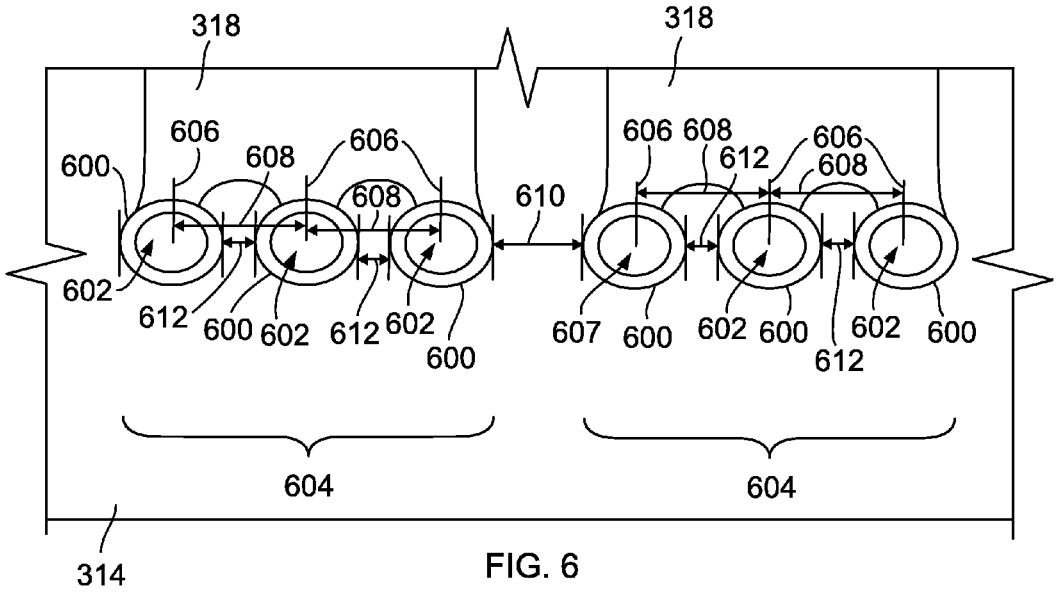
FIG. 6 is a plan view of a plurality of annular rings disposed on the circuit board shown in FIG. 3 according to one embodiment.

FIG. 6 is a plan view of a plurality of annular rings 600 disposed on the circuit board 314. The annular rings 600 may be similar to the annular rings 500 (shown in FIG. 5). The annular rings 600 may be electrically connected to the power traces 318 in the circuit board 314. Each of the annular rings 600 surrounds an opening 602 that receives the upper or lower power contact mounting end 212, 222 (shown in FIG. 2) of the upper or lower power contact 104, 216 (shown in FIGS. 1 and 2, respectively). The annular rings 600 may be arranged in a group 604. The group 604 may include two or more of the annular rings 600 separated by a separation distance 612. In one embodiment, the separation distance 612 between adjacent annular rings 600 is smaller than the clearance spacing 512 (shown in FIG. 5). Alternatively, the separation distance 612 may be the same or greater than the clearance spacing 512. While each group 604 in the illustrated embodiment includes three annular rings 600, a different number of annular rings 600 may be provided in each group 604 in another embodiment. The upper or lower power contact mounting ends 212, 222 for a given upper or lower power contact 104, 216 are inserted into the openings 602 and then secured within the openings 602 by flowing solder between the upper or lower power contact mounting ends 212, 222 and the annular rings 600. The solder secures the upper or lower power contact mounting ends 212, 222 within the openings 602 and electrically connects the upper or lower power contact mounting ends 212, 222 to the annular rings 600 and to the power traces 318.

As the upper or lower power contact mounting ends 212, 222 for a given group 604 of annular rings 600 are directly connected to a single upper or lower power contact 104, 216 (shown in FIGS. 1 and 2, respectively) in one embodiment, the annular rings 600 may be spaced closer together than in known connectors. For example, center lines 606 of the annular rings 600 may be separated from one another by a pitch 608. In one embodiment, the pitch 608 is less than the mating spacing 320 (shown in FIG. 3) between the center lines of adjacent upper and lower power contact mating ends 124, 126 (shown in FIG. 1). The pitch 608 may be less than the mating spacing 326 (shown in FIG. 3) between the center lines of adjacent upper and lower signal contact mating ends 128, 130 (shown in FIG. 1). The pitch 608 may be less than the pitch 512 (shown in FIG. 5) of known connectors. For example, the pitch 608 may be approximately 2.0 millimeters or less. In another example, the pitch 608 may be approximately 2.1 millimeters or less. A different pitch 608 may be used in another embodiment.

By providing the annular rings 600 in each of the groups 604 closer together than the mating spacing 320, the mating spacing 326 and/or the pitch 512 (shown in FIGS. 3 and 5, respectively), the groups 604 of annular rings 600 may be separated by a greater distance while not taking up any additional real estate on the circuit board 314. For example, the groups 604 may be separated by a clearance spacing 610 that is greater than the clearance spacing 512 (shown in FIG. 5) between the annular rings 500 (shown in FIG. 5). The clearance spacing 610 may be larger than the mating spacing 320 and/or the mating spacing 326. In one embodiment, the clearance spacing 610 is approximately 1.43 millimeters or more. In another embodiment, the clearance spacing 610 is approximately 1.77 millimeters or more. Other clearance spacing 610 distances may be provided in another embodiment.

In one embodiment, the upper and lower power contact mating ends 124, 126 (shown in FIG. 1) are provided in a pattern at the mating end 108 (shown in FIG. 1) of the connector assembly 100 (shown in FIG. 1) and the upper and lower power contact mounting ends 212, 222 (shown in FIG. 2) are provided in a different pattern at the mounting end 120 (shown in FIG. 1) of the connector assembly 100. The pattern at the mating end 108 may be defined by the mating spacing 320 (shown in FIG. 3) between the upper and lower power contacts 104, 216 (shown in FIGS. 1 and 2, respectively) and the mating spacing 328 between the outermost ones of the upper and lower power contact mating ends 124, 126 in adjacent upper or lower power contacts 104, 216. The pattern at the mounting end 120 may be defined by the pitch 608 between the annular rings 600 on the circuit board 314 (that receives the upper and lower power contact mounting ends 212, 222) and the clearance spacing 610 between the groups 604 of the annular rings 600. The pattern at the mating end 108 may be arranged to permit the connector assembly 100 to mate with industry standard mating connectors (not shown) and/or circuit boards.

By increasing the clearance separation 610 between the adjacent groups 604 of the annular rings 600 over the clearance separation 512 (shown in FIG. 5) of known connectors, increasing amounts of power may be communicated using the connector assembly 100 when compared to known connectors. Moreover, increasing amounts of power may be communicated without the need to take up additional real estate on the circuit board 314 and/or removing the upper power contacts 104, lower power contacts 216, upper signal contacts 106, and/or lower signal contacts 238, as is done in known connectors.

Figure 7:
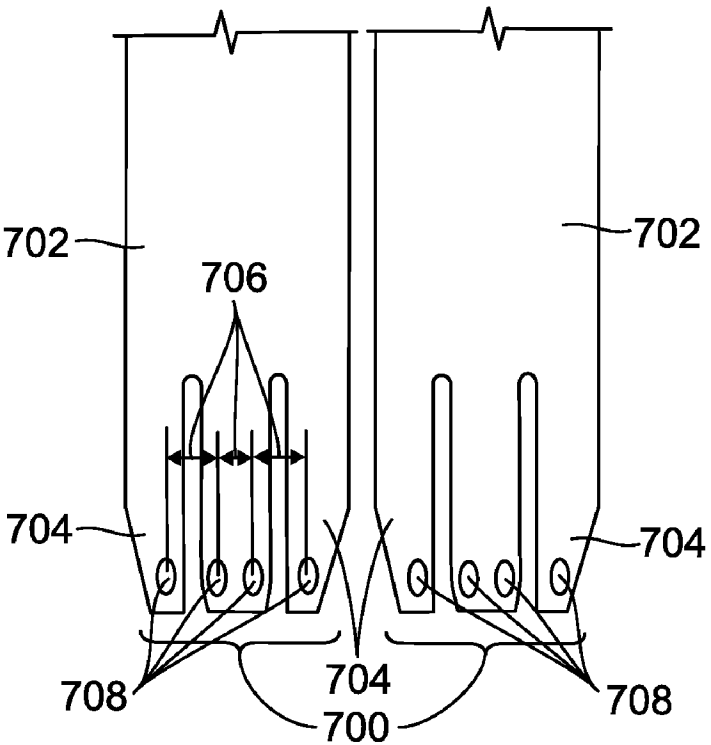
FIG. 7 is an elevational view of a plurality of power contact mating ends for a plurality of power contacts according to an alternative embodiment.

FIG. 7 is an elevational view of a plurality of power contact mating ends 700 for a plurality of power contacts 702 according to an alternative embodiment. The power contacts 702 may be similar to one or more of the upper power contacts 104 (shown in FIG. 1) and the lower power contacts 216 (shown in FIG. 2). The power contact mating ends 700 may be similar to one or more of the upper power contact mating ends 124 (shown in FIG. 1) and the lower power contact mating ends 126 (shown in FIG. 1), with the exception that the outermost power contact mating ends 704 are tapered or chamfered inward.

Each of the power contact mating ends 700, 704 includes a contact area 708 that is separated from the contact area 708 of an adjacent power contact mating end 700, 704 by the mating spacing 706. Alternatively, the mating spacing 706 between two or more of the power contact mating ends 700, 704 may differ from the mating spacing 706 for a different pair of power contact mating ends 700, 704, or a pair of power contact mating ends 700, 704 that includes at least one different power contact mating end 700, 704. The contact area 708 includes the area of the power contact mating end 700, 704 that engages a corresponding contact (not shown) in a connector that mates with the connector (not shown) housing the power contact 702. In the illustrated embodiment, the center power contact mating end 700 includes two contact areas 708 and the outermost power contact mating ends 704 include a single contact area 708. Alternatively, the center power contact mating end 700 includes more than one contact area 708 and/or the center power contact mating end 700 includes a different number of contact areas 708. In the embodiment illustrated in FIG. 3, the mating spacing 320 may include the distance between the contact areas (not shown) of the upper power contact mating ends 124. For example, the contact areas of the upper power contact mating ends 124 may centered on the upper power contact mating ends 124.

By tapering or chamfering the outermost power contact mating ends 704, a mating spacing 706 of the power contact mating ends 700, 704 may be less than the mating spacing 320 (shown in FIG. 3) of the upper and lower power contact mating ends 124, 126. For example, the contact areas 708 of the power contact mating ends 700, 704 may be spaced closer together than the center lines of the upper power contact mating ends 126 and/or the lower contact mating ends 124. Locating the contact areas 708 and the power contact mating ends 700, 704 closer together permits mounting portions (not shown) of the power contacts 702 to be spaced closer together. For example, the mounting portions of the power contacts 702 may be similar to the mounting portions 210 (shown in FIG. 2) of the upper power contacts 124 and/or to the mounting portions 220 (shown in FIG. 2) of the lower power contacts 126. As the power contact mating ends 700, 704 are closer together when compared to the upper and lower power contact mating ends 124, 126, the mounting portions of the power contacts 702 may be closer together than the mounting portions 210, 220 of the upper and lower power contacts 124, 126.

Figure 8:
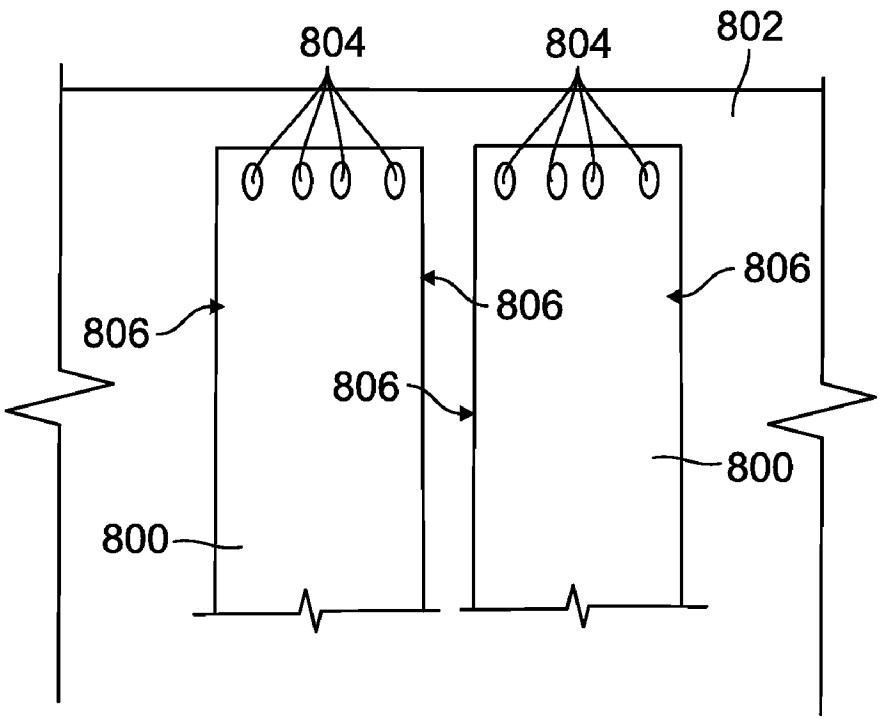
FIG. 8 is an elevational view of a plurality of power traces in a circuit board according to an alternative embodiment.

FIG. 8 is an elevational view of a plurality of power traces 800 in a circuit board 802 according to an alternative embodiment. The power traces 800 may be similar to the power traces 318 (shown in FIG. 3) and the circuit board 802 may be similar to the circuit board 314 (shown in FIG. 3). In the illustrated embodiment, the power traces 800 may include a plurality of oval shaped annular rings 804. The annular rings 804 may be similar to the annular rings 600 shown in FIG. 6. For example, the annular rings 804 may be circular.

The power traces 800 and annular rings 804 are configured to receive the mounting portions (not shown) of the power contacts 702 (shown in FIG. 7). As described above, the power contact mating ends 700, 704 (shown in FIG. 7) are closer together than the upper and lower power contact mating ends 124, 126 (shown in FIG. 1). By placing the power contact mating ends 700, 704 closer together, the mounting portions of the power contacts 702 may be placed closer together. Placing the mounting portions of the power contacts 702 closer together allows the annular rings 804 to be spaced closer together. In known connectors, the annular rings used to electrically connect the mounting portions of the power contacts in the connectors with power traces are spaced farther apart. Due to this greater spacing between the annular rings, the outermost annular rings may be located adjacent or proximate to the outer edges of the power traces. If the manufacturing tolerances of the circuit board and the power traces are not sufficiently small, the power traces may not be sufficiently aligned with the mounting portions of the power contacts. As a result, the mounting portions may not electrically connect with the power trace and/or the annular rings. Conversely, by placing the annular rings 804 closer together, the outermost annular rings 804 may be located farther from opposing edges 806 of the power traces 800. Placing the annular rings 804 farther from the edges 806 may allow the manufacturing tolerances of the circuit board and the power traces to be greater. For example, greater error in placing the power traces in the circuit board may be permitted while still providing for an electrical connection between the mounting ends of the power contacts 702 and the annular rings 804 and/or power traces 800.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and merely are example embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim 1imitations expressly use the phrase "means for" followed by a statement of function void of further structure.

What is claimed is:

1. A connector assembly comprising:

a housing that is elongated along a longitudinal axis, the housing having channels extending between a housing mating end and an opposing back end, the housing mating end configured to mate with a mating connector; and a plurality of signal contacts disposed in the housing, each of the signal contacts including a signal contact mating end and a signal contact mounting end; and a plurality of power contacts disposed in the housing, each of the power contacts having a plurality of power contact mating ends and a plurality of power contact mounting ends, the power contact mating ends linearly aligned with each other in a direction parallel to the longitudinal axis, the power contact mounting ends linearly aligned with each other in a direction parallel to the longitudinal axis and configured to be mounted to a circuit board, wherein the signal contact mating ends and the power contact mating ends are linearly aligned with each other in a first direction oriented parallel to the longitudinal axis.

2. The connector assembly of claim 1, wherein the power contact mounting ends for each power contact are configured to provide a single electrical connection with the circuit board such that each of the power contacts provides a conductive pathway between a plurality of contacts in the mating connector and a single conductive trace in the circuit board.

3. The connector assembly of claim 1, wherein the housing has a mounting side that interconnects the mating side and the back end with each of the channels in the housing having an insertion opening at the back end, the power contact mating ends inserted into the channels through the insertion openings.

4. The connector assembly of claim 3, wherein the insertion openings are collinear along a direction parallel to the longitudinal axis of the housing.

5. The connector assembly of claim 1, wherein the power contact mating ends and the power contact mounting ends of each contact are elongated in perpendicular directions.

6. The connector assembly of claim 1, wherein the housing comprises a housing mounting end configured to be mounted to the circuit board, the power contact mating ends being arranged in a first pattern at the mating end, the power contact mounting ends being arranged in a second pattern at the housing mounting end.

7. The connector assembly of claim 1, wherein the power contact mating ends of the signal contacts are separated from each other by a mating spacing measured parallel to the longitudinal axis and the power contact mating ends of each power contact are separated from each other by the same mating spacing measured parallel to the longitudinal axis.

8. The connector assembly of claim 1, wherein the signal contact mounting ends of the signal contacts and the power contact mounting ends of the power contacts are linearly aligned with each other in a second direction that is oriented parallel to the longitudinal axis.

9. A connector assembly comprising:

a housing having comprising a mating end configured to mate with a mating connector and a mounting end configured to be mounted to a circuit board;

a plurality of contacts each comprising a plurality of mating ends and a plurality of mounting ends, the mating ends configured to engage corresponding contacts in the mating connector, the mounting ends configured to be mounted to the circuit board and provide an electrical connection between the contacts and the circuit board, the mating ends arranged in a first pattern at the mating end and the mounting ends arranged in a second pattern at the mounting end, the mounting ends being more tightly grouped in the second pattern than the mating ends in the first pattern, wherein the mounting ends are configured to be inserted into a group of annular rings of the circuit board that are separated from one another by a first separation distance and the groups of annular rings are separated from one another by a second separation distance that is greater than the first separation distance.

10. The connector assembly of claim 9, wherein the mounting ends of each contact are arranged in a group, center lines of outermost ones of the mounting ends in each group being separated from the center lines of the outermost mounting ends in neighboring groups by a distance that is greater than a pitch of the mating ends of the contacts.

11. The connector assembly of claim 9, further comprising a plurality of lower contacts each comprising a plurality of lower contact mating ends and a plurality of lower contact mounting ends, the lower contact mating ends configured to engage corresponding contacts in the mating connector, the lower contact mounting ends configured to be mounted to the circuit board and provide an electrical connection between the lower contacts and the circuit board, the lower contact mating ends arranged in the first pattern at the mating end and the lower contact mounting ends arranged in the second pattern at the mounting end, the lower contact mounting ends being more tightly grouped in the second pattern than the lower contact mating ends in the first pattern.

12. The connector assembly of claim 11, wherein the contact mating and mounting ends are substantially perpendicular to one another and the lower contact mating and mounting ends are substantially perpendicular to one another.

13. The connector assembly of claim 11, wherein each of the contacts includes an upper contact plate and each of the lower contacts includes a lower contact plate, the mating ends of the contacts connected to a mating portion of the upper contact plate, the mounting ends of the contacts connected to a mounting portion of the contact plate, the lower contact mating ends connected to a mating portion of the lower contact plate, the lower contact mounting ends connected to a mounting portion of the lower contact plate, the mating and mounting portions of the upper contact plates being substantially perpendicular to one another, the mating and mounting portions of the lower contact plates being substantially perpendicular to one another.

14. The connector assembly of claim 9, wherein center lines of the mating ends are separated by a first pitch and the mounting ends are configured to be inserted into the annular rings having center lines separated by a second pitch that is smaller than the first pitch.

15. The connector assembly of claim 9, wherein the upper contact is one of a plurality of upper contacts and the lower contact is one of a plurality of lower contacts, the upper contact mounting ends in neighboring upper contacts and the lower contact mounting ends in neighboring lower contacts separated such that the annular rings into which the upper and lower contact mounting ends are inserted are separated by the second separation distance.

16. A connector assembly comprising:

a housing elongated along a longitudinal axis, the housing configured to mate with a mating connector and to be mounted to a circuit board;

a plurality of signal contacts held in the housing, each of the signal contacts including a signal contact mating end and a signal contact mounting end; and a plurality of power contacts held in the housing, each of the power contacts including a plurality of power contact mating ends that mate with contacts of the mating connector and a plurality of power contact mounting ends, the power contact mounting ends being disposed side-by-side in a direction that is parallel to the longitudinal axis of the housing and the power contact mating ends disposed side-by-side in a direction that is parallel to the longitudinal axis, wherein the signal contact mating ends and the power contact mating ends are linearly aligned with each other in a first direction that is oriented parallel to the longitudinal axis and are separated from each other by a common spacing distance measured along the longitudinal axis.

17. The connector assembly of claim 16, wherein the housing comprises a plurality of upper channels and a plurality of lower channels extending between insertion openings at the housing mating end and the back end, and further comprising a plurality of lower contacts each having a plurality of lower contact mating ends and a plurality of lower contact mounting ends, each of the lower contact mating ends extending through one of the lower channels and configured to provide a second plurality of electrical connections with the mating connector, the lower contact mounting ends of each lower contact configured to be mounted to the circuit board, further wherein center lines of the lower contact mating ends are separated by the first mating spacing and center lines of the lower contact mounting ends by the mounting spacing.

18. The connector assembly of claim 17, wherein the insertion openings of the channels are collinear on an upper row of openings and the insertion openings of the lower channels are collinear on a lower row of openings, the upper and lower row of openings being parallel to the longitudinal axis of the housing.

19. The connector assembly of claim 16, wherein one or more of the power contact mating ends of the power contacts have outer chamfered edges.

20. The connector assembly of claim 16, wherein the power contacts include an upper power contact and a lower power contact held in the housing, the power contact mating ends of the lower power contact disposed between the power contact mating ends of the upper power contact and the circuit board when the housing is mounted to the circuit board.

21. The connector assembly of claim 16, wherein the plurality of power contacts includes an upper power contact and a lower power contact held in the housing, the power contact mounting ends of the lower power contact disposed between the power contact mounting ends of the upper power contact and the housing.

22. The connector assembly of claim 16, wherein the signal contact mounting ends of the signal contacts and the power contact mounting ends of the power contacts are linearly aligned with each other in a second direction that is oriented parallel to the longitudinal axis.

* * * * *